United States Patent [19]

Welch

[11] Patent Number: 4,896,721

[45] Date of Patent: Jan. 30, 1990

[54] LOCATOR SHIFTER TOOL

[75] Inventor: William R. Welch, Carrollton, Tex.

[73] Assignee: Otis Engineering Corporation, Dallas, Tex.

[21] Appl. No.: 322,906

[22] Filed: Mar. 14, 1989

[51] Int. Cl.[4] ..... E21B 23/00

[52] U.S. Cl. ..... 166/214; 166/217; 166/237

[58] Field of Search ..... 166/206, 214, 217, 237, 166/382; 285/1, 2

[56] References Cited

U.S. PATENT DOCUMENTS

| | | | |
|---|---|---|---|
| 2,960,165 | 11/1960 | Schramm | 166/214 |
| 3,874,634 | 1/1975 | Gazda | 251/319 |
| 3,990,511 | 1/1976 | Gazda | 164/224 R |
| 4,043,392 | 8/1977 | Gazda | 166/217 |
| 4,378,839 | 4/1983 | Fisher, Jr. | 166/382 |
| 4,436,152 | 3/1984 | Fisher, Jr. | 166/214 |
| 4,540,048 | 9/1985 | Gazda | 166/214 |

*Primary Examiner*—Bruce M. Kisliuk

*Attorney, Agent, or Firm*—Roland O. Cox

[57] ABSTRACT

An improved locator shifter tool useful in a string of well operating tools. When the tool string is lowered into compatible internal profiled grooving in a well conduit, profiled keys on the locator shifter tool move outwardly into the profiled grooving, stopping downward movement of the shifting tool and tool string. A downward force on the tool string will now operate the locator shifter tool to lock connected in the profiled grooving in the conduit. To disconnect the locator shifter from the profiled grooving, an upward force on the tool string will operate the locator shifter tool to cam the keys inwardly from the conduit grooving, disconnecting the locator shifter and tool string for raising through the conduit back to the surface.

10 Claims, 2 Drawing Sheets

LOCATOR SHIFTER TOOL

BACKGROUND OF THE INVENTION (1) Technical Field

This invention relates to well tools and particularly relates to tools used to selectively locate and lock in compatible profiled grooving in a well conduit.

(2) Background Information

Various devices are used in well conduits to control the flow of fluids in the well while completing or producing a well. Many of these devices are operated by a string of operating tools which includes a shifting tool of the type shown in U.S. Pat. No. 4,436,152 to Fisher, Jr. and Welch and herein incorporated for reference. The string of tools is lowered into the well conduit via wireline or pumpdown well servicing techniques. When the tool string shifting tool is moved downwardly into compatible profiled grooving in the well conduit or device in the conduit to be operated, profiled keys on the shifting tool are moved outwardly into and held engaged in the compatible profiled grooving by springs under the keys, connecting the the tool string in the compatible grooving. After the tool string with shifting tool is connected, the tool string is moved downwardly by jarring or by pumping to operate the device in the well conduit as required. On upward movement of the tool string, the locator shifter tool is automatically disconnected from the profiled grooving.

While using the shifting tool of the previously incorporated U.S. patent, it was found the impact forces of downward jarring or fluid pumped downwardly on the tool string and shifting tool would cause the tool keys to move out of engagement with the profiled grooving, prematurely disconnecting the shifting tool from the profiled grooving.

DISCLOSURE OF THE INVENTION

The improved locator shifter of this invention is provided with profiled keys and springs biasing the keys outwardly toward expanded position for locating and engaging the keys within compatible profiled grooving. The improved tool also includes upper and lower expander surfaces on an inner mandrel, which are moveable downwardly inside the keys for locking the keys in the expanded and engaged position connecting the locator shifter and the profiled grooving together until disconnect is desired.

An object of this invention is to provide an improved locator shifter tool having profiled keys which will automatically expand to locate and engage compatible internal profiled grooving in a well conduit when moved into the compatible grooving.

Another object of this invention is to provide an improved locator shifter having a key with a profile including a down-force load bearing shoulder for locating in compatible internal profiled grooving.

A principal object of this invention is to provide a locator shifter tool having profiled keys which may be locked in expanded and engaged position, locking the shifting tool connected in profiled grooving.

Another object of this invention is to provide an improved locator shifter having a key with a profile including a down-force load bearing shoulder and an up-force load bearing shoulder for locating and locking connected in profiled grooving.

Also an object of this invention is to provide an improved locator shifter tool which may be operated to retract keys when required for disconnect from profiled grooving.

BEST MODE FOR CARRYING OUT THE INVENTION

Figure 1:
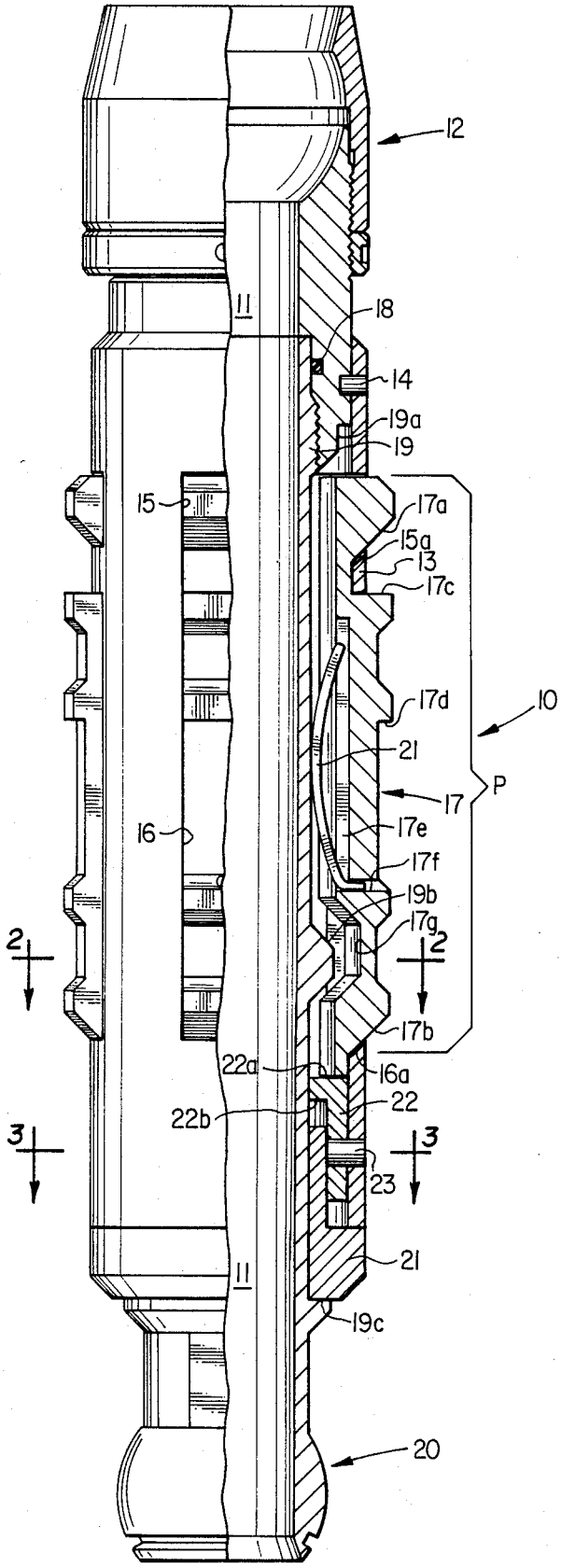
FIG. 1 is a sectioned drawing in elevation, showing the locator shifting tool of this invention with keys expanded in profiled grooving engaging position.

FIG. 1 shows the preferred form of the improved locator shifter tool 10, which has a through flow passageway 11 and an appropriate connection 12 for connecting the tool in a string of operating tools. An outer key mandrel 13 around the lower portion of connection 12 is releasably positioned on the connection by a shearable pin 14. The key mandrel has a number of slots 15 and an equal number of openings 16. The lower end of each slot is provided with an arcuate camming surface **15*a* and the lower end of each opening 16 is provided with an arcuate camming surface 16*a***.

Figure 6:
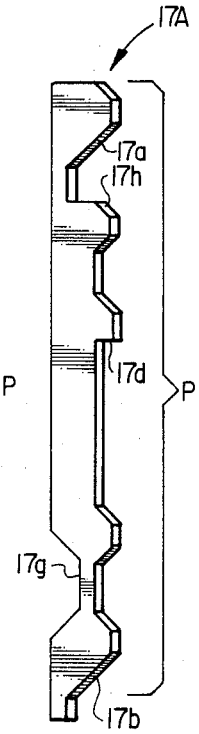
FIG. 6 is a drawing in elevation of an alternate key useful on the tool of FIG. 1.

A key 17 or 17A is mounted for radial movement through the openings and larger openings. Profiled grooving P is provided on the outside surface of each key for engaging compatible profiled grooving in the well conduit. Each key has arcuate camming surfaces **17*a* and 17*b* and profiled grooving P for key 17 includes an up-force bearing shoulder 17*c* and down-force bearing shoulder 17*d*. Alternate key 17A shown in FIG. 6 also has arcuate camming surfaces 17*a* and 17*b*. The profile P on key 17A does not include up-force bearing shoulder 17*c*, but has in place of 17*c* a camming surface 17*h***.

Figure 2:
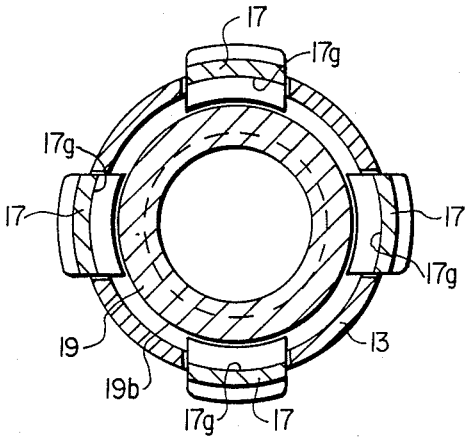
FIG. 2 is a cross section drawing along line 2—2 of FIG. 1.
Figure 3:
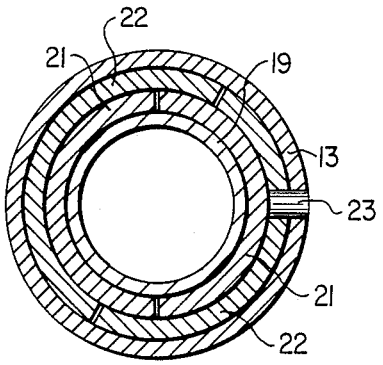
FIG. 3 is a cross section drawing along line 3—3 of FIG. 1.

Threadedly connected to connection 12 and sealed with resilient seal 18 is an inner mandrel 19. This mandrel has an upper expander surface **19*a* and a lower shoulder on which there is an expander surface 19*b* (see also FIG. 2) and a shoulder 19*c*. On the lower end of the inner mandrel, there is an appropriate connection 20 for connecting the lower end of shifting tool 10** into an operating tool string.

A longitudinal groove **17*e* is provided in the inside surface of keys 17 and 17A to house a spring 21 between each key and the outside of the inner mandrel. Each spring is positioned by one end of the spring in keyhole 17*f* and biases a key into the expanded position as shown in FIG. 1. Each key also has an internal groove 17*g*. A split collar 21 is mounted low around inner mandrel 19 and rests on shoulder 19*c*. A spring ring 22 is mounted around the collar and inner mandrel. The ring has a surface 22*a* and an internal shoulder 22*b*. At least one shearable pin 23 releasably positions shoulder 22*b* a spaced distance above the upper end of collar 21 with surface 22*a* contacting the lower end of keys 17 or 17A**.

Figure 4:
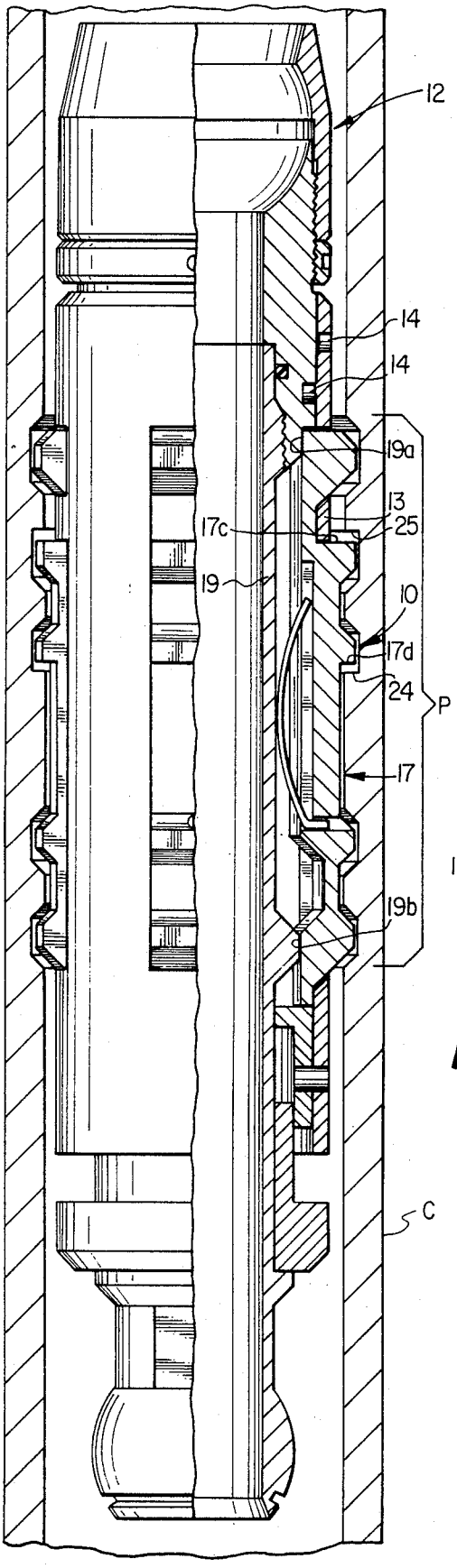
FIG. 4 is a drawing similar to FIG. 1, showing the invention locator shifter with keys locked in expanded position and connected in compatible profiled grooving in a conduit.

The improved locator shifter tool carrying keys 17 or 17A is used to locate and engage a compatible profile is a well conduit by connecting into a string of operating tools (not shown) and lowering into a well conduit. The inside diameter of the conduit will be smaller than the outside diameter of the keys in expanded position. When tool 10 is lowered into the conduit, keys 17, 17A are moved inwardly compressing springs 21. The compressed springs exert an outward bias on the keys urging them toward expanded position in the conduit, causing the keys to drag on the inside of the conduit as the tool string and locator shifter tool are moved downwardly. When the locator shifter is moved into compatible profiled grooving in a conduit, compressed springs move the keys outwardly into expanded position in the profiled grooving and downward movement of locator shifter and operating tool string is stopped by key shoulder **17*d* on keys 17 or 17A, engaging shoulder 24 in the internal profiled grooving P in well conduit C as shown in FIG. 4. If tool 10 carried keys 17, these keys in expanded position in the conduit profiled grooving have connected the locator shifter tool and profiled grooving together. The tool string and tool 10 with keys 17 cannot move upwardly out of the internal profiled grooving because key shoulder 17*c* contacts shoulder 25 in the profiled grooving in conduit C. Upward movement of keys 17** now tends to move the conduit profile upwardly.

If tool 10 carried alternate keys 17A, the tool string and tool can now be moved upwardly out of the profiled grooving because keys 17A are cammed inwardly as camming surface **17*h* is moved upwardly along the internal corner of conduit shoulder 25**.

To lock the locator shifter with keys 17 or 17A connected in the conduit grooving, downward jarring or a sustained downward force is applied to the upper end of the tool string and shifting tool 10 moves downward until key shoulder **17*d* contacts shoulder 24 in conduit profile P. Now moving inner mandrel 19 downwardly in outer mandrel 13, shears pin 14 and moves expander surfaces 19*a* and 19*b* downwardly in the keys, locking them in the expanded position and connecting the locator shifter in the conduit grooving, as shown in FIG. 4**.

Figure 5:
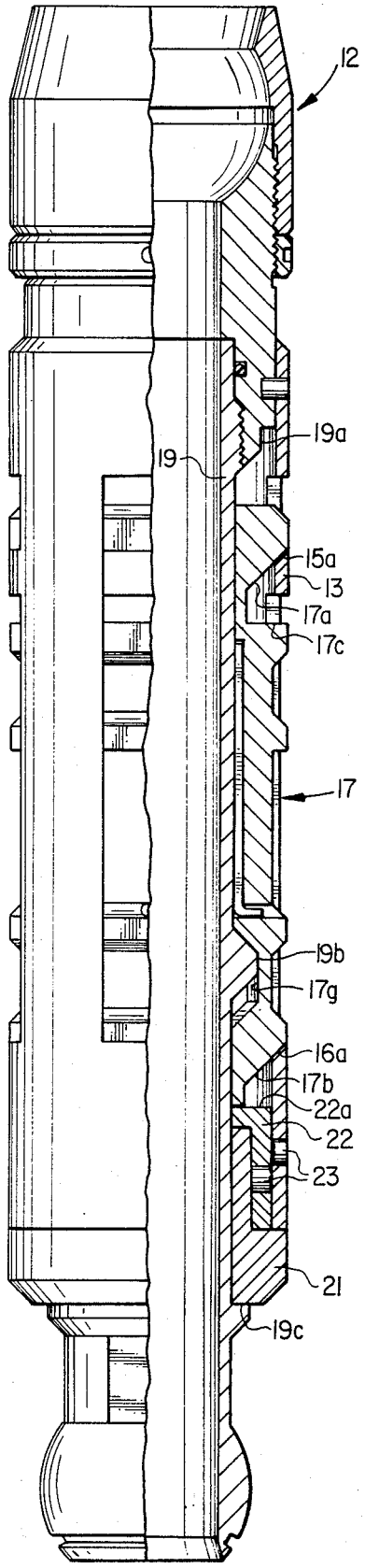
FIG. 5 is a drawing similar to FIG. 1, showing the keys in retracted position.

If the locator shifter with keys 17 or 17A does not disconnect or cannot be disconnected from the profiled grooving in conduit C, the tool may be operated to retract the keys and disconnect from the conduit grooving by upward jarring or applying a sustained upward force to inner mandrel 19 from the tool string above through connection 12 sufficient to shear pin 23. If the keys are locked connected in the conduit profile, upward force on mandrel 19 through shoulder **19*c* moves collar 21 upwardly and expander surfaces 19*a* and 19*b* from inside the keys until the collar contacts the lower end of mandrel 13. Keys 17 prevent upward movement of ring 22 and continued upward movement of inner mandrel 19 and outer mandrel 13 shears pin 23. Simultaneously, outer mandrel camming surfaces 16*a* and 15*a* have moved upwardly along key camming surfaces 17*b* and 17*a*, camming the keys inwardly while sliding the lower end of each key across split ring surface 22*a*. Expander surface 19*b* is received in key grooves 17*g* as the keys are moved to retracted position contacting the inner mandrel as shown in FIG. 5**. The locator shifter tool and tool string are disconnected from the conduit profile and may now be raised to the surface.

What I claim is:

1. An improved locator shifter tool comprising:

(a) an inner mandrel having upper and lower expander surfaces;

(b) an outer key mandrel around said inner mandrel, said outer key mandrel having a plurality of openings, a slot above each opening, each said opening and slot having a camming surface along a lower surface thereof;

(c) a key having profiled grooving thereon mounted for radial movement in each opening and slot thereabove, each said key having an upper camming surface engageable with said slot camming surface and a lower camming surface engageable with said opening camming surface;

(d) biasing means for biasing said keys toward expanded position;

(e) a locking means comprising said inner mandrel upper and lower expander surfaces engageable with the inside surface of each key for locking said keys in expanded position; and (f) releasable positioning means for positioning said keys in radially moveable position; said positioning means releaseable on upwardly movement of said inner mandrel relative to said outer mandrel for engaging said key and outer mandrel camming surfaces and moving said keys to retracted position.

2. The locator shifter tool of claim 1 wherein profiled grooving on each key includes an up-force bearing shoulder and a down-force bearing shoulder.

3. The locator shifter tool of claim 1 wherein the profiled grooving on each key includes a down-force bearing shoulder.

4. The locator shifter tool of claim 1 wherein the biasing means are springs between the inner mandrel and keys.

5. The locator shifter tool of claim 1 wherein the locking means are upper and lower expander surfaces on the inner mandrel, said surfaces engageable with the inside of each key.

6. The locator shifter tool of claim 5 wherein each key further includes an internal groove for receiving the lower expander surface.

7. The locator shifter tool of claim 5 wherein the releasable positioning means comprise:

(a) an external shoulder on the inner mandrel below the lower expander surface;

(b) a split ring around said inner mandrel between said inner mandrel external shoulder and the expander surface;

(c) a sleeve having an internal shoulder around said split ring; and (d) at least one frangible pin through the outer mandrel and said sleeve, said pin positioning said sleeve internal shoulder a spaced distance above the upper end of said split ring.

8. An improved locator shifter tool comprising:

(a) an inner mandrel having upper and lower expander surfaces thereon and an external shoulder on said inner mandrel below said lower expander surface;

(b) an outer key mandrel around said inner mandrel, said outer key mandrel having a plurality of openings, a slot above each opening, each said opening and slot having a camming surface along a lower surface thereof;

(c) a key having profiled grooving thereon mounted for radial movement in each opening and slot thereabove, each said key having an upper camming surface engageable with said slot camming surface and a lower camming surface engageable with said opening camming surface;

(d) a spring between each key and said inner mandrel, said springs biasing said keys toward expanded position, said inner mandrel upper and lower expander surfaces engageable with the inside of said keys to lock said keys in expanded position;

(e) a split ring around said inner mandrel between said inner mandrel external shoulder and said lower expander surface;

(f) a split sleeve having an internal shoulder around said split ring; and (g) at least one frangible pin through said outer mandrel and said sleeve, said pin positioning said sleeve internal shoulder a spaced distance above the upper end of said ring.

9. The locator shifter tool of claim 8 wherein the profiled grooving on the key includes an up-force bearing shoulder and a down-force bearing shoulder.

10. The locator shifter tool of claim 8 wherein the profiled grooving on the key includes a down-force bearing shoulder.

* * * * *